US009013154B2

(12) United States Patent
O'Sullivan

(10) Patent No.: US 9,013,154 B2
(45) Date of Patent: Apr. 21, 2015

(54) TECHNIQUE FOR FULLY DISCHARGING A STORAGE CAPACITOR IN A FIRING CIRCUIT FOR AN ELECTRO-EXPLOSIVE DEVICE

(75) Inventor: Paul B. O'Sullivan, Westford, MA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 585 days.

(21) Appl. No.: 13/377,900

(22) PCT Filed: Apr. 8, 2011

(86) PCT No.: PCT/US2011/031757

§ 371 (c)(1),
(2), (4) Date: Dec. 13, 2011

(87) PCT Pub. No.: WO2011/127391

PCT Pub. Date: Oct. 13, 2011

(65) Prior Publication Data

US 2012/0086409 A1 Apr. 12, 2012

Related U.S. Application Data

(60) Provisional application No. 61/321,906, filed on Apr. 8, 2010.

(51) Int. Cl.

| | |
|---|---|
| ***H02J 7/00*** | (2006.01) |
| ***F42B 3/12*** | (2006.01) |
| ***F42C 19/12*** | (2006.01) |

(52) U.S. Cl.

CPC ..... *F42B 3/121* (2013.01); *F42C 19/12* (2013.01)

(58) Field of Classification Search

CPC ..... H02J 7/345
USPC ..... 320/166
See application file for complete search history.

(56) References Cited

U.S. PATENT DOCUMENTS

| | | | | |
|---|---|---|---|---|
| 4,389,940 | A | 6/1983 | Trembly et al. | |
| 4,617,866 | A * | 10/1986 | Simpson | 102/262 |
| 5,022,485 | A | 6/1991 | Mitchell | |
| 5,023,556 | A | 6/1991 | Miller | |
| 6,611,130 | B2 * | 8/2003 | Chang | 323/235 |
| 6,634,298 | B1 * | 10/2003 | Denney | 102/206 |
| 7,511,974 | B2 * | 3/2009 | Chu et al. | 363/21.13 |
| 2007/0273335 | A1 * | 11/2007 | Duff, Jr. | 320/166 |
| 2008/0278882 | A1 | 11/2008 | Saliga | |
| 2009/0108815 | A1 * | 4/2009 | Overland et al. | 320/166 |
| 2010/0102782 | A1 * | 4/2010 | Thiesen et al. | 320/166 |
| 2011/0062919 | A1 * | 3/2011 | Hung et al. | 320/166 |

* cited by examiner

*Primary Examiner* — Yalkew Fantu
(74) *Attorney, Agent, or Firm* — Maine Cernota & Rardin; Andrew P. Cernota

(57) ABSTRACT

A firing circuit configured for complete discharge of a storage capacitor is provided with a storage capacitor, an inductor, a diode, a transistor switch having a gate to which the inductor and the diode are connected in series, the inductor and the capacitor being configured for inductor capacitor ringing, the inductive capacitive ringing creating upon initiation of the circuit a gate voltage at the gate above an initial capacitor voltage of the storage capacitor; and the diode blocking the discharge of the gate voltage ensuring that the capacitor can be fully discharged.

8 Claims, 3 Drawing Sheets

TECHNIQUE FOR FULLY DISCHARGING A STORAGE CAPACITOR IN A FIRING CIRCUIT FOR AN ELECTRO-EXPLOSIVE DEVICE

RELATED APPLICATIONS

This application claims the benefit of U.S. Provisional Application No. 61/321,906, filed Apr. 8, 2010. This application is herein incorporated by reference in their entirety for all purposes.

STATEMENT OF GOVERNMENT INTEREST

The invention was made with United States Government support under Contract No. W31P4Q-06-C-0330 awarded by the Navy. The United States Government has certain rights in this invention.

FIELD OF THE INVENTION

The invention relates to miniature electro-explosive devices (EEDs) and more particularly to electro-explosive devices activated with complete discharge of a storage capacitor.

BACKGROUND OF THE INVENTION

Many miniature electro-explosive devices (EEDs) are fired (activated) by the rapid discharge of the energy stored in a storage capacitor into the bridgewire of the EED by the closure of a switch, typically a Field Effect Transistor (FET). In many designs, the capacitor is not able to be fully discharged because as the capacitor voltage drops (as the discharge progresses), the gate-to-source voltage across the FET drops below the turn-on threshold, essentially turning off the switch. Fully discharging the capacitor is desirable to increase the reliability of firing the EED, but a method is needed to achieve this in a low-cost fashion utilizing a minimum number of components, particularly in applications where the volume available for the firing circuit is limited.

What is needed, therefore, are techniques for fully discharging a storage capacitor.

SUMMARY OF THE INVENTION

One embodiment of the present invention provides a firing circuit configured for complete discharge of a storage capacitor, the firing circuit comprising: a storage capacitor; an inductor; a diode; a transistor switch having a gate to which the inductor and the diode are connected in series; the inductor and the capacitor being configured for inductor capacitor ringing, the inductive capacitive ringing creating upon initiation of the circuit a gate voltage at the gate having a greater magnitude than the initial capacitor voltage of the storage capacitor; and the diode blocking the discharge of the gate voltage ensuring that the capacitor can be fully discharged.

Another embodiment of the present invention provides such a firing circuit further comprising a transistor switch disposed between the capacitor and the inductor.

A further embodiment of the present invention provides such a firing circuit wherein the transistor switch is a field effect transistor.

Still another embodiment of the present invention provides such a firing circuit wherein the field effect transistor is a p-type field effect transistor.

Even another embodiment of the present invention provides such a firing circuit where the capacitor is a gate to source capacitance of the field effect transistor.

An even further embodiment of the present invention provides such a firing circuit wherein the diode is a forward biased diode.

Yet another embodiment of the present invention provides such a firing circuit wherein a gate voltage of the transistor switch, upon triggering of the firing circuit swings to a negative value approximately equal to a voltage of the storage capacitor less a forward voltage of the diode.

A yet further embodiment of the present invention provides such a firing circuit wherein a gate to source voltage of the field effect transistor is the difference between twice a storage capacitor voltage and a diode forward voltage.

A still yet further embodiment of the present invention provides such a firing circuit wherein during discharge; a gate to source voltage of the first field effect transistor remains substantially constant.

One embodiment of the present invention provides a method for the complete discharge of a storage capacitor in a firing circuit, the method comprising: instantiating an inductive capacitive ringing in the firing circuit thereby creating a negative gate voltage of a field effect transistor equal to a voltage of the capacitor less a forward voltage of a diode; preventing the flow of current in an opposite direction by disposing a positive bias diode before the field effect transistor gate.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

Figure 1:
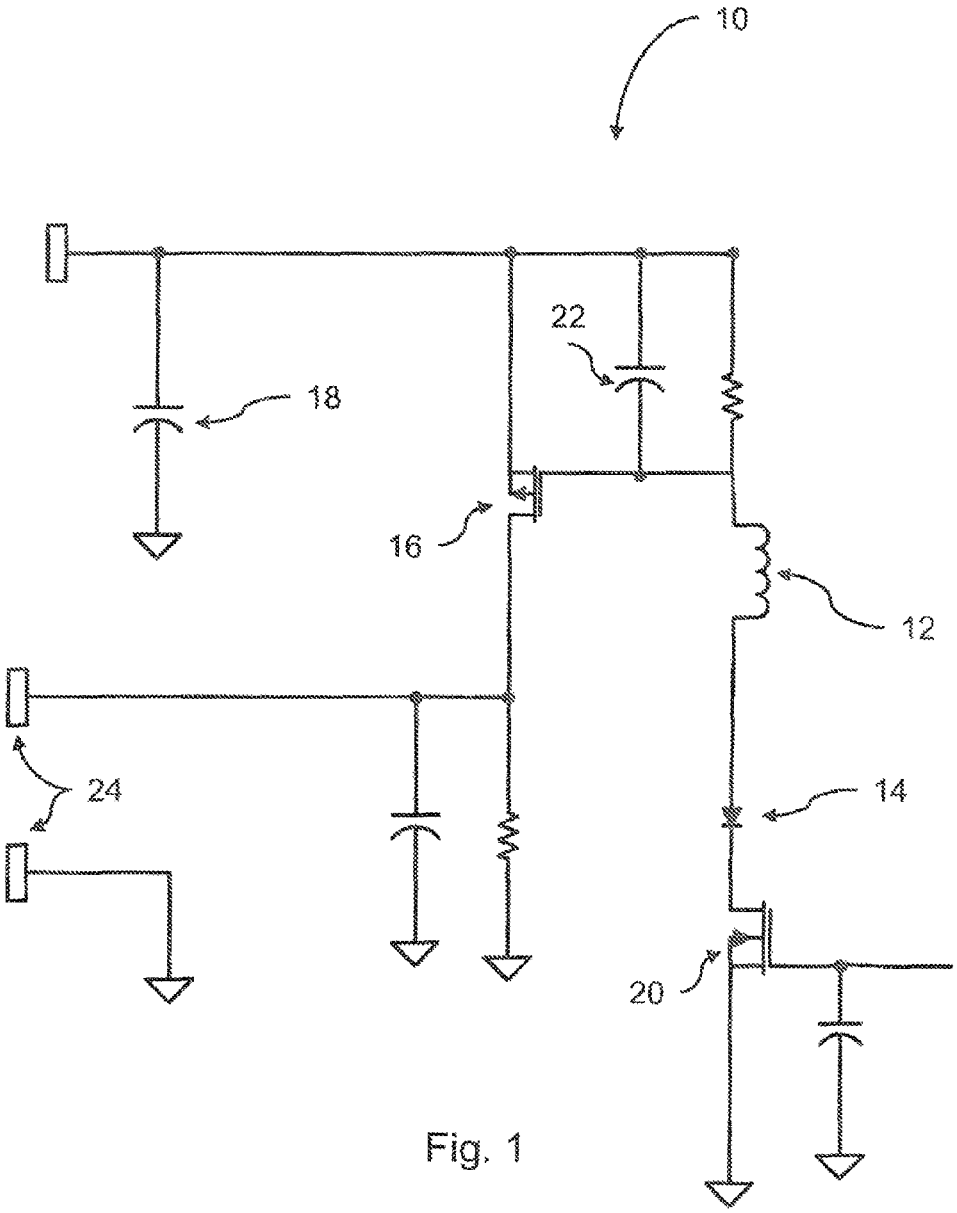
FIG. 1 is a circuit diagram illustrating a circuit configured in accordance with one embodiment of the present invention.

A circuit 10 configured according to one embodiment of the present invention and illustrated in FIG. 1 consisting of an inductor 12 and a diode 14, connected to the gate of the FET 16, provides a simple and cost-effective solution to the problem of incomplete discharge of a capacitor in a firing circuit with a minimum number of added components. The circuit illustrated in FIG. 1 showing the added inductor 12 and diode 14. Inductive capacitive ringing of this circuit increases the gate voltage at the Gate FET 16 to a value higher than the initial voltage of the storage capacitor 18; the diode 14 blocks the discharge of the gate voltage ensuring that the capacitor 18 can be fully discharged (as long there is continuity in the bridgewire).

In such an embodiment, the circuit 10 provides an inductor 12, a diode 14, a storage capacitor 18 (in some embodiments the gate to source capacitance of the FET may serve as the capacitor), and a FET having a gate 16 to which the inductor 12 and the diode 14 are connected in series.

Figure 2:
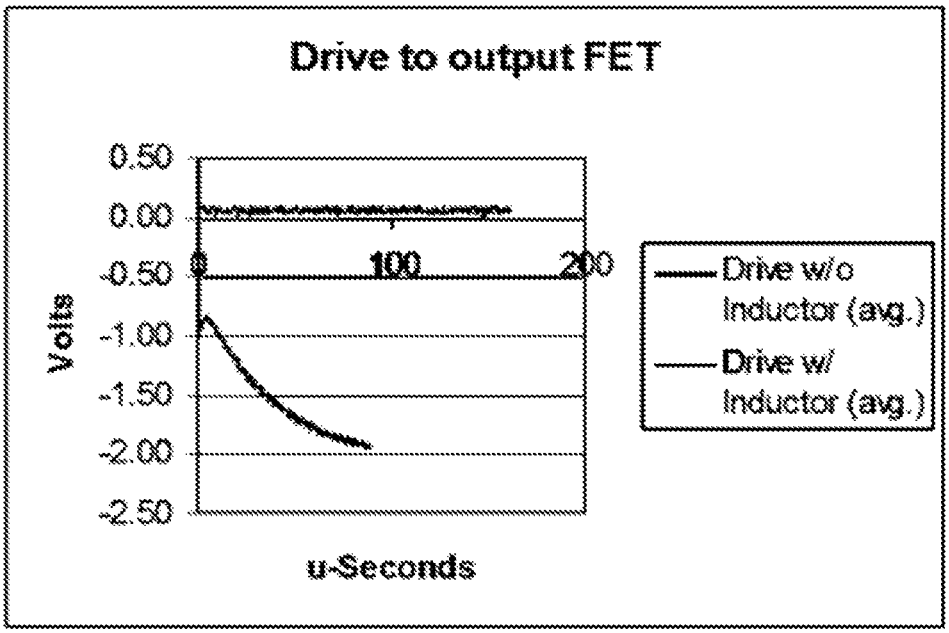
FIG. 2 is a graph of Drive to output FET of a circuit configured in accordance with one embodiment of the present invention.
Figure 3:
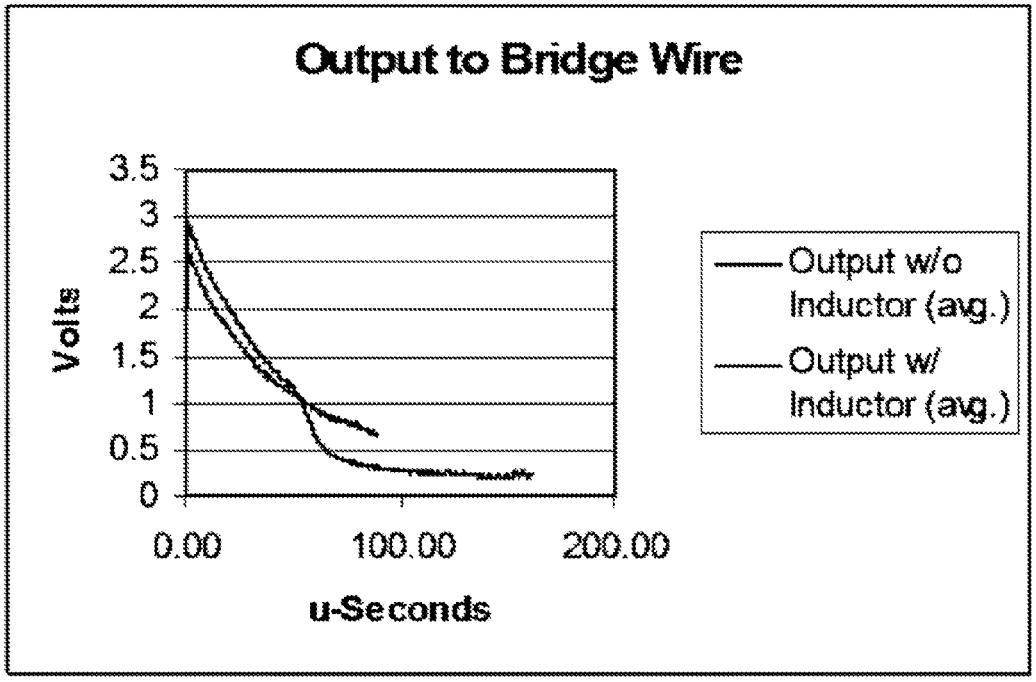
FIG. 3 is a graph of output to bridgewire of a circuit configured in accordance with one embodiment of the present invention.

The other end of the series connected diode 14 and inductor 12 are connected to a transistor switch 20 (in some embodiments such a transistor switch may be FET or Bipolar transistor) which connects the diode and inductor to ground when a firing trigger pulse is received at the gate of the transistor 20. When triggered the circuit 10 creates inductor capacitor ringing, thus providing a FET 16 gate voltage, as illustrated in FIG. 2, that swings below ground to a negative level that is approximately equal to the storage capacitor voltage minus the forward voltage of the diode 14. The gate to source voltage of the FET 16 is therefore equal to 2 times the storage capacitor voltage minus the forward voltage of the diode as opposed to just the storage capacitor voltage in the known methods. Further once the Gate to source voltage has swung to its most negative value the diode prevents current from flowing in the opposite direction and therefore stops further ringing thereby maintaining the peak FET gate to source voltage. Further as the storage capacitor voltage drops during its discharge the FET gate to source voltage remains relatively constant since there is not a rapid discharge path for the capacitor 18. The FET therefore remains in its low resistance state providing for complete storage capacitor discharge.

One embodiment of the present invention provides a firing circuit 10 configured for complete discharge of a storage capacitor 18, the firing circuit comprising: a storage capacitor 18; an inductor 12; a diode 14; a transistor switch 16 having a gate to which the inductor 12 and the diode 14 are connected in series; the inductor 12 and the capacitor 22 being configured for inductor capacitor ringing, the inductive capacitive ringing creating upon initiation of the circuit a source to gate voltage at the FET 16 that is higher than the initial capacitor voltage of the storage capacitor 18; and the diode 14 blocking the discharge of the gate voltage ensuring that the capacitor 22 can be fully discharged. In one such embodiment, the firing circuit 10 has the transistor switch 16 disposed between the capacitor 18 and one terminal of the EED bridgewire 24.

In various embodiments of the present invention, the transistor switch 16 may be a field effect transistor, for instance a p-type field effect transistor.

In alternative embodiments, the capacitor 22 may be a gate to source capacitance of the field effect transistor.

In such a system the gate voltage of the transistor switch, upon triggering of the firing circuit swings to a negative value approximately equal to a voltage of the storage capacitor less a forward voltage of the diode or a gate to source voltage of the field effect transistor is the difference between twice a storage capacitor voltage and a diode forward voltage.

A still yet further embodiment of the present invention provides such a firing circuit wherein during discharge; a gate to source voltage of the transistor switch remains substantially constant.

One embodiment of the present invention provides a method for the complete discharge of a storage capacitor in a firing circuit, the method including instantiating a inductive capacitive ringing in the firing circuit thereby creating a negative gate voltage of a field effect transistor equal to a voltage of the capacitor less a forward voltage of a diode; preventing the flow of current in an opposite direction by disposing a positive bias diode before the field effect transistor gate.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure.

That which is claimed is:

1. A firing circuit configured for complete discharge of a storage capacitor, said firing circuit comprising:

the storage capacitor; an inductor receiving output of said storage capacitor;

a diode; a transistor switch having a gate to which said inductor and said diode are connected in series said diode being disposed between said inductor and said transistor switch;

said inductor and said capacitor being configured for inductor capacitor ringing, said inductive capacitive ringing creating upon initiation of said circuit a gate voltage at said gate above an initial capacitor voltage of said storage capacitor; and said diode blocking the discharge of said gate voltage ensuring that the capacitor is fully discharged;

wherein a gate voltage of said first field effect transistor, upon triggering of said firing circuit swings to a negative value equal to a voltage of said storage capacitor less a forward voltage of said diode.

2. The firing circuit of claim 1 wherein said transistor switch disposed between said capacitor and a bridgewire.

3. The firing circuit of claim 1 wherein said transistor switch is a field effect transistor.

4. The firing circuit of claim 3 wherein said field effect transistor is an P-type field effect transistor.

5. The firing circuit of claim 1 where said capacitor is a gate to source capacitance of a field effect transistor.

6. The firing circuit of claim 1 wherein a gate to source voltage of said field effect transistor is the difference between twice a storage capacitor voltage and a diode forward voltage.

7. The firing circuit of claim 1 wherein during discharge, a gate to source voltage of said first field effect transistor remains constant.

8. A method for the complete discharge of a storage capacitor in a firing circuit, said method comprising:

instantiating an inductive capacitive ringing in said firing circuit thereby creating a negative gate voltage of a field effect transistor equal to 2 times a voltage of said capacitor less a forward voltage of a diode;

preventing the flow of current in an opposite direction and stops further ringing thereby maintain the peak field effect transistor (FET) gate to source voltage remains constant, and the FET remains in its low resistance state providing for complete storage capacitor discharge.

* * * * *